US005300747A

United States Patent [19]

Simon

[11] Patent Number: 5,300,747

[45] Date of Patent: Apr. 5, 1994

[54] COMPOSITE MATERIAL FOR A MICROWAVE HEATING CONTAINER AND CONTAINER FORMED THEREFROM

[75] Inventor: Frederick E. Simon, Lindenwold, N.J.

[73] Assignee: Campbell Soup Company, Camden, N.J.

[21] Appl. No.: 763,235

[22] Filed: Sep. 20, 1991

Related U.S. Application Data

[63] Continuation-in-part of Ser. No. 380,326, Jul. 17, 1989, abandoned.

[51] Int. Cl.[5] ..... H05B 6/80

[52] U.S. Cl. ..... 219/729; 99/DIG. 14; 426/107; 426/113; 426/234; 426/243; 427/97; 427/99; 428/221; 428/328

[58] Field of Search ..... 219/10.55 E, 10.55 F, 219/10.55 M; 426/107, 113, 234, 237, 243; 427/45.1, 28, 213, 218, 412.5, 97, 99; 428/429, 449, 363, 423.7, 454, 221, 328; 99/DIG. 14; 252/63.2, 63.5

[56] References Cited

U.S. PATENT DOCUMENTS

| | | | |
|---|---|---|---|
| 3,655,565 | 4/1972 | McDonald | 428/363 |
| 3,951,904 | 4/1976 | Tomonga | 260/40 R |
| 3,960,807 | 6/1976 | McTaggart | 428/36.92 |
| 4,190,757 | 2/1980 | Turpin et al. | 219/10.55 E |
| 4,266,108 | 5/1981 | Anderson et al. | 219/10.55 E |
| 4,308,312 | 12/1981 | Urban | 428/363 |
| 4,336,361 | 6/1982 | Tsuruta et al. | 428/323 |
| 4,348,463 | 9/1982 | Ohno et al. | 428/429 |
| 4,375,494 | 3/1983 | Stokes | 428/323 |
| 4,462,947 | 7/1984 | Huggard | 264/54 |
| 4,463,121 | 7/1984 | Gartland et al. | 428/36.92 |
| 4,466,933 | 8/1984 | Huggard | 264/54 |
| 4,491,618 | 1/1985 | Kuwajima et al. | 428/363 |
| 4,503,168 | 3/1985 | Hartsing, Jr. | 523/100 |
| 4,518,651 | 5/1985 | Wolfe, Jr. | 219/10.55 B |
| 4,542,268 | 9/1985 | Jarvis et al. | 219/10.55 E |
| 4,542,271 | 9/1985 | Tanonis et al. | 523/137 |
| 4,555,439 | 11/1985 | Ueeda et al. | 428/480 |
| 4,572,852 | 2/1986 | Gartland et al. | 428/36.92 |
| 4,576,842 | 3/1986 | Hartsing, Jr. | 428/483 |
| 4,576,856 | 3/1986 | Kuwajima et al. | 428/363 |
| 4,579,882 | 4/1986 | Kanbe et al. | 528/137 |
| 4,585,823 | 4/1986 | Saito et al. | 524/456 |
| 4,601,952 | 7/1986 | Doyle et al. | 428/454 |
| 4,603,088 | 7/1986 | Sklarski et al. | 428/454 |
| 4,623,565 | 11/1986 | Huybrechts et al. | 428/363 |
| 4,626,557 | 12/1986 | Duska et al. | 523/100 |
| 4,637,852 | 1/1987 | Sklarski | 428/363 |
| 4,661,671 | 4/1987 | Maroszek | 219/10.55 E |
| 4,693,941 | 9/1987 | Ostapchenko | 428/480 |
| 4,711,860 | 12/1987 | Gadkaree et al. | 501/9 |
| 4,737,389 | 4/1988 | Harsting, Jr. et al. | 428/36.6 |
| 4,766,163 | 8/1988 | Strudwick | 523/509 |
| 4,873,137 | 10/1989 | Deyrup | 428/325 |
| 4,894,503 | 1/1990 | Wendt | 426/107 |
| 4,931,538 | 6/1990 | Yoshifumi et al. | 528/308.6 |
| 4,933,526 | 6/1990 | Fisher et al. | 219/10.55 E |
| 4,952,420 | 8/1990 | Walters | 427/97 |
| 5,021,293 | 6/1991 | Huang et al. | 428/328 |
| 5,057,659 | 10/1991 | Schneider et al. | 219/10.55 E |

*Primary Examiner*—Bruce A. Reynolds
*Assistant Examiner*—Tu Hoang
*Attorney, Agent, or Firm*—Banner, Birch, McKie & Beckett

[57] ABSTRACT

A composite material for efficient use in a microwave heating container and a container formed therefrom are described. The composite material includes a thermoplastic resin and a particulate dielectric material oriented therein so the container exhibits a dielectric constant within the range from about 5 to about 8 which is particularly useful for heating high moisture foods in microwave ovens. The particulate dielectric material includes particles having a dielectric constant within a range from about 5 to about 8 and a particle size within the range from about 1 μm to about 10 μm.

14 Claims, No Drawings

COMPOSITE MATERIAL FOR A MICROWAVE HEATING CONTAINER AND CONTAINER FORMED THEREFROM

This application is a continuation-in-part of copending application Ser. No. 380,326 filed Jul. 17, 1989, abandoned.

BACKGROUND OF THE INVENTION

The present invention generally relates to a composite material for a microwave heating container and, more specifically, to a microwave heating container which minimizes both the amount of microwave energy reflected and the amount of microwave energy absorbed by the container.

Microwave energy can be reflected, absorbed, or passed through the walls of a cooking container. The relative degree of which each is desired depends on the application. Coatings or materials that primarily reflect microwaves are used as a shielding for electrical components and antenna. Shielding materials are not good for cooking containers because the energy is not transmitted to the food within.

Coatings or materials that primarily absorb microwave energy become heated. These heated surfaces are useful for browning the surface of relatively low moisture, solid foods. Absorbing surfaces are not useful for heating high moisture foods such as soups, sauces, or batters. The amount of energy absorbed can be measured by the "loss tangent". Materials having a loss tangent of less than $10\times10^{-4}$ do not absorb appreciable amounts of energy and do not become hot during use.

Microwave reflection can be explained by looking at the rate of change of the dielectric constants between different transmission media. Ideally, one would design a container having a smooth gradient of dielectric constants between air ($k=1$) and the contained food. Such a container would be expensive and impractical.

It would be desirable to have a material and microwave cooking container made therefrom which would transmit microwave energy without substantial reflection or absorption.

SUMMARY OF THE INVENTION

It is an object of the present invention to provide a microwave heating container which minimizes reflected microwave energy.

It is another object of the present invention to provide a microwave heating container which minimizes absorbed microwave energy.

It is yet another object of the present invention to provide a microwave heating container which reduces the cooking time of food contained therein.

In accordance with the present invention, there is provided a composite material which includes a thermoplastic resin and a particulate dielectric material additive oriented and dispersed therein. The particulate dielectric material has a dielectric constant within a range from about 5 to about 8. Composite materials according to the invention act as a transition material particularly suitable for containers used to heat high moisture foods because the transition reduces microwave energy off the liquid interface and absorbs low levels of microwave energy. As a result, microwave cookware from the composite heats contained high moisture foods quickly and evenly.

One advantage of utilizing the inventive dielectric additives in cooking containers is a reduction in the cooking time of unfrozen, high moisture foods such as soups, sauces and batters. Shorter cooking times reduce the possibility of boil-out, over drying at the edges and corners, and steam bubble formation otherwise known as "bumping".

DETAILED DESCRIPTION

The composite material of the invention comprises a plastic resin matrix having dispersed therein up to about 40% of resin weight of a particulate dielectric additive. Suitable resins include polyesters, epoxies, polytetrafluoroethylene (Teflon®), silicone plastics, methylpentene plastics, polycarbonates, nonbranching polyethylene, melamine, and crystalline polyethylene terephthalate (CPET). Foamed or unfoamed CPET are preferred matrix materials.

The particulate dielectric additive should have a dielectric constant of about 5 to about 8 and a particle size within the range from about 1 μm to about 10 μm in quantities sufficient to produce a container having a dielectric constant of about 5 to about 8, preferably a dielectric constant of about 6 to about 8. This range of constants is particularly useful for high moisture foods such as soups, sauces, batters, etc. As used herein, "high moisture" refers to foods having at least about 40 wt % water.

Containers with dielectric constants of about 5 to about 8 reduce the amount of microwave energy reflected from the interface with the moisture in high moisture foods and/or absorbed by the container. This omission of energy diversion results in an efficient energy transmission to the food and high rates of heating. If the container is dedicated to a specific, high moisture food with a substantially constant dielectric constant, the proportions of dielectric additive may be further tailored to optimize heating efficiency by the exercise of no more than the existing skill level in this art.

The dielectric additive should also have a loss tangent less than about $100\times10^{-4}$, preferably less than about $20\times10^{-4}$, and more preferably less than about $8\times10^{-4}$.

Suitable particulate dielectric additives include mica, alumina, sapphire, PYROCERAM TM (a proprietary, hard, strong, opaque-white glass with a nonporous, crystalline structure having high shock resistance and flexural strength) cordierite, forsterite, porcelain (dry and wet process), zircon porcelain, steatite, and those materials having the desired dielectric and loss tangent properties which are available for waveguides, communications, and/or radar applications. The preferred dielectric additives are mica, PYROCERAM TM (a proprietary, hard, strong, opaque-white glass with a nonporous, crystalline structure having high shock resistance and flexural strength) sapphire, and alumina. Their properties are listed in Table 1. The most preferred additive is muscovite mica.

TABLE 1

| Material | Dielectric Constant (k) | Loss Tangent |
|---|---|---|
| Mica | 6–7.5 | $3\times10^{-4}$ |
| PYROCERAM TM | 6–7.5 | $4\times10^{-4}$ |
| Alumina | 8–10 | $7\times10^{-4}$ |
| Sapphire | 8–10 | $2\times10^{-4}$ |

One additional property common to each of the preferred materials is an "aspect ratio" less than about 40. Preferably, the aspect ratio of the additive material is less than about 30 and more preferably is less than about 20 or even within the range from about 3–15. The "aspect ratio" is the ratio of the lengths of the widest particle surface to the narrowest particle surface. For mica which has a monoclinic crystal structure and fractures into thin, parallel sheets, the aspect ratio is the sheet width to the thickness.

Preferably, the dielectric additive particles are oriented within the matrix so that the particle's widest surface is in a plane substantially parallel to at least one container surface wall. One way of orienting the particles is to use a single screw extruder with appropriate forming and molding methods within the skill of the art. A single screw extruder transports the composite in one direction without substantial transverse mixing such as occurs in a twin screw extruder. Unidirectional flow permits the additive particles to align naturally with the flow vectors. The composite (with aligned particles) can then be extruded as a sheet from which containers are formed.

The composite material of the invention can be used to produce a container having a loss tangent lower than the base matrix plastic. As an example, CPET has a loss tangent of about $40\times10^{-4}$. When mixed with 40 wt. % muscovite mica, the composite has a loss tangent of about $5\times10^{-4}$ which represents an 87% reduction in the amount of energy absorbed by the container.

Containers according to the invention which can be made from the composites of the invention exhibit a shape that contacts at least 50% of the total food surface area when the food is placed in the container. This container contact ratio includes the contact area of all elements of the container such as a bowl with an accompanying lid. Preferably, the container will contact at least 75% of the total contained surface area. Even more preferable is a container shape that contacts at least 90–100% of the contained food surface area. The use of vented lids made from the present composites is particularly useful for contacting as much food surface area as possible thereby providing high levels of contact area that act as a transition aid to reduce the amount of reflected microwave energy.

Because high moisture foods will often exhibit a liquid, flowable consistency without a specific shape at room temperature, the contact area ratio is conveniently calculated as the ratio of the container's interior surface area to the surface area of any open, uncontacted food interface. As an example of containers exhibiting contact area ratios in accordance with the invention, an open cylinder with an internal diameter of 3 cm and a filled height of 6 cm would present a contact surface area ratio of about 86%. A flat plate, however, would effectively exhibit less than a 50% contact area because the food thickness and entire upper surface area would not contact the container material.

The following examples will assist in an understanding of the present invention.

EXAMPLE 1

In example 1, circular bowls made from CPET with a polypropylene lid (samples A and B) were compared to mica/CPET circular bowls exhibiting a 43.7% contact ratio with mica/CPET lids (samples C and D) exhibiting a 56.3% contact ratio. Bowls and lids exhibited the same shapes.

For the mica/CPET bowls, polyethylene terephthalate resin with an intrinsic viscosity of 0.95 was mechanically mixed with 25% by weight of muscovite mica. The mica/CPET lids contained 30% mica. The mixture was dried at 160° C. for 6 hours to a moisture level of less than 25 ppm. For the bowls, 3% low-density polyethylene (by weight of the PET resin) was added to the dry blend which was then extruded through a single screw extruder at 270° C. to form a sheet of 0.030 inches thick having mica well dispersed and oriented therein. The sheet was subsequently thermoformed into circular bowls of approximately 200 ml capacity and crystallized. The mica/CPET lids were injection molded to form a sheet of material of 0.125 inches in thickness and cut into lids suitable for covering the bowls used in the example.

The microwave heating of composite mica/CPET was examined using an oven having approximately 600 Watts of microwave power on the HIGH setting. A fluoroptic temperature probe and a chart recorder were used to continuously monitor the temperature at four locations within the tray. The tray was centered within the oven and each experiment was repeated. The trays were weighed, filled with approximately 160 ml of distilled water, and re-weighed to determined the mass of the water. The trays were covered so that the lids contacted the upper surface of the water thereby reducing evaporative cooling effects and identifying the effect of differing lid materials. The trays were heated on HIGH power for five minutes without stirring. The variable TIME refers to the time, in seconds, required to heat the water from 250° C. to 450° C. was determined from the chart record. The energy absorbed was calculated according to the formula:

$$e_{ABS}=(4.184\ \text{Watt-sec/cal})\times(\text{g of } H_2O)\times(20^\circ\ \text{C./TIME})$$

where 1 calorie is the energy required to raise the temperature of 1 g. of water by 1° C.

The results of the heating tests are reported in Table 2.

TABLE 2

| | A (PP/CPET) | B (PP/CPET) | C (mica/CPET) | D (mica/CPET) |
|---|---|---|---|---|
| Temperature rise (°C.) | 20.0 | 20.0 | 20.0 | 20.0 |
| Mass $H_2O$ (g.) | 163.4 | 161.9 | 165.8 | 162.6 |
| Time to heat (sec.) | 38.7 | 33.1 | 27.4 | 32.3 |
| Energy absorbed (W) | 353 | 409 | 506 | 421 |
| | Average = 381 | | Average = 464 | |

The measurements reveal a 21% faster microwave heating rate with water filled composite mica/CPET containers and lids compared to CPET containers without mica.

Results using other combinations of lids and trays are in Table 3 and show the improved heating that occurs when mica/CPET lids having the tested contact ratio of greater than 50% are used. Samples E and F are mica/CPET bowls with polypropylene lids. Samples G and H are CPET bowls with mica/CPET lids.

TABLE 3

| | E | F | G | H |
|---|---|---|---|---|
| Temperature rise (°C.) | 20.0 | 20.0 | 20.0 | 20.0 |

TABLE 3-continued

| | E | F | G | H |
|---|---|---|---|---|
| Mass $H_2O$ (g.) | 147.0 | 161.6 | 156.2 | 152.8 |
| Time to heat (sec.) | 28.4 | 35.3 | 30.4 | 30.4 |
| Energy absorbed (W) | 383 | 433 | 430 | 421 |
| | Average = 408 | | Average = 426 | |

EXAMPLE 2

The microwave heating of mica-filled CPET was examined by infrared thermal imaging. Sixteen eight-ounce circular bowls having the shape of example 1 were made of aluminum foil, unaugmented CPET, metallized polyester laminated boardstock (microwave susceptor), and 25% mica-filled CPET were filled with 180 grams of pancake batter and frozen for 24 hours. The containers were individually microwaved for two minutes on HIGH power in an oven. Available power was approximately 550 Watts. The bowls were immediately examined using an Agema thermal imaging system.

The mica-filling increased the overall heating rate of the batter as compared to the unfilled CPET. An additional advantage of the mica was seen in the reduction of the overall range of temperatures from the hotter outer edge of the cooler center. The susceptor board tray allowed heating rates similar to the mica filled CPET tray, but had significant edge over-heating and cool center. The purpose of the susceptor is to convert microwave energy to sensible surface heating.

TABLE 4

| | Average Temperatures (°C.) | | | |
|---|---|---|---|---|
| Tray Material | Maximum | Minimum | Median | Range |
| mica/CPET | 96.3 | 67.4 | 80.2 | 28.9 |
| CPET | 99.4 | 57.8 | 74.5 | 41.6 |
| Aluminum | 74.5 | 48.2 | 58.4 | 26.3 |
| Susceptor | 101.3 | 60.4 | 80.0 | 40.8 |

The invention has been described and exemplified with but one embodiment within the scope of the invention. Other embodiments are within the scope and spirit of the invention as outlined by the appended claims.

I claim:

1. A composite material for use in the construction of a microwave heating container, the composite material comprising a plastic resin and a particulate dielectric material oriented therein, said particulate dielectric material having a dielectric constant within a range of about 5 to about 8, a loss tangent value of less than $8\times10^{-4}$, and a particle size of 1 μm to about 10 μm in a quantity sufficient to produce a dielectric constant of about 5 to about 8 for said composite.

2. The composite material according to claim 1 wherein the plastic resin comprises crystalline polyethylene terephthalate.

3. The composite material according to claim 1 wherein said particulate dielectric material comprises at least one of mica, alumina, and sapphire,

4. The composite material according to claim 3 wherein said particulate dielectric material consists essentially of muscovite mica.

5. The composite material according to claim 1 wherein said particulate dielectric material exhibits an aspect ratio of less than about 30.

6. The composite material according to claim 1 comprising up to about 40% by weight of said particulate dielectric material.

7. A microwave heating container exhibiting a shape having a contact area ratio of at least about 50% when containing liquids and being made of a composite material comprising a plastic resin and a particulate dielectric material oriented therein whereby said container exhibits a dielectric constant within the range from about 5 to about 8, said particulate dielectric material comprising particles having a dielectric constant within a range of about 5 to about 8, a loss tangent value of less than about $8\times10^{-4}$, and a particle size of about 1 μm to about 10 μm in a quantity sufficient to produce a dielectric constant of about 5 to about 8 for said container.

8. The microwave heating container according to claim 7 wherein the plastic resin comprises crystalline polyethylene terephthalate.

9. The microwave heating container according to claim 7 wherein the particulate dielectric material comprises at least one of mica, alumina, and sapphire.

10. The microwave heating container according to claim 9 wherein said particulate dielectric material comprises muscovite mica.

11. The microwave heating container according to claim 7 wherein said particulate dielectric material exhibits a widest surface and said widest surface is oriented to be substantially parallel to at least one wall surface of said container.

12. The microwave heating container according to claim 7 wherein the composite material comprises up to about 40% by weight of particulate dielectric material.

13. The microwave heating container according to claim 7 wherein said particulate dielectric material exhibits an aspect ratio of less than about 40.

14. The microwave heating container according to claim 13 wherein the aspect ratio is less than about 30.

* * * * *